United States Patent [19]

Moseley et al.

[11] 4,002,519

[45] Jan. 11, 1977

[54] APPARATUS AND METHOD FOR FORMING POUCHES

[75] Inventors: Ronald E. Moseley, Rock Hill, S.C.; Henry G. Stewart, Harrisburg, N.C.

[73] Assignee: Engraph, Inc., Charlotte, N.C.

[22] Filed: Feb. 12, 1975

[21] Appl. No.: 549,462

[52] U.S. Cl. ..... 156/204; 83/39; 83/917; 93/33 R; 93/35 R; 156/227; 156/270; 156/290; 156/306; 156/465; 156/510; 156/529; 156/583

[51] Int. Cl.[2] ..... B31B 1/14; B31B 1/22; B31B 19/14; B31B 21/14

[58] Field of Search ..... 156/200, 204, 217, 227, 156/250, 267, 270, 290, 320, 322, 324, 465, 510, 515, 306, 529, 583; 53/28, 31, 41, 180, 206; 93/33 R, 33 H, 61 R, 63 R, 63 M, 35 R; 83/917, 39

[56] References Cited

UNITED STATES PATENTS

| | | | |
|---|---|---|---|
| 1,944,794 | 1/1934 | Klinger | 93/63 M |
| 2,474,775 | 6/1949 | Borchers | 93/61 R |
| 2,929,180 | 3/1960 | Abrams et al. | 53/39 |
| 3,277,763 | 10/1966 | Haug | 83/917 |
| 3,327,576 | 6/1967 | Heywood | 83/917 |
| 3,454,441 | 7/1969 | Spruyt | 156/267 |
| 3,470,795 | 10/1969 | Davis, Jr. | 156/267 |
| 3,493,456 | 2/1970 | Vilutis | 156/515 |
| 3,531,359 | 9/1970 | Jones et al. | 156/515 |
| 3,537,360 | 11/1970 | Farnam | 93/33 R |
| 3,575,090 | 4/1971 | Hook | 93/33 H |
| 3,575,763 | 4/1971 | Ramsey | 156/515 |
| 3,599,538 | 8/1971 | Piazze | 93/33 H |
| 3,843,483 | 10/1974 | Sendor et al. | 156/499 |

*Primary Examiner*—Charles E. Van Horn
*Assistant Examiner*—Basil J. Lewris
*Attorney, Agent, or Firm*—Bell, Seltzer, Park & Gibson

[57] ABSTRACT

Successive pouches are formed from a web of plastic film by advancing the web through a folding station and folding the web along a longitudinal fold line to form a two-ply portion and a single ply portion adjacent thereto. At a sealing station, confronting surfaces of the two-ply folded portion of the web are sealed together along longitudinally spaced apart seal areas extending transversely across the two-ply portion to define a series of successive pouches interconnected by the seal areas. At a flap forming station predetermined waste areas are severed and removed from the single ply portion of the web to form the same into a series of successive flaps extending alongside each of the pouches and adapted for being folded over the pouches to close the same. The predetermined waste areas are quickly severed and removed by first piercing the single ply web at a predetermined point spaced from the free longitudinal edge thereof and corresponding to one end of the waste area, and then severing the single ply portion from the point of piercing along two spaced apart cut lines extending to the free longitudinal edge thereof. The waste area is graspingly engaged closely adjacent to the free longitudinal edge during severing to facilitate severing the waste area free from the remaining web, and is thereafter ejected clear of the advancing web by a blast of air. After heat sealing and flap formation, the web is advanced to a cut-off station and successively severed transversely across the folded web and across a medial portion of each seal area to separate the interconnected pouches from one another.

19 Claims, 6 Drawing Figures

APPARATUS AND METHOD FOR FORMING POUCHES

This invention relates to the manufacture of pouches, and it is a primary object of this invention to provide an improved machine and method for converting a web of plastic packaging film into successive pouches.

More particularly, it is an object of this invention to provide an improved machine and method particularly adapted for forming pouches suitable for use as a reusable container for various products, such as hosiery, wearing apparel, etc., the pouches having a tapered closing flap extending therefrom with rounded corners, and the flaps being adapted to be folded over the pouches to close the same.

It is a further object of this invention to provide an improved machine and method particularly adapted for forming pouches from heat sealable plastic packaging films of relatively heavy gauge, e.g. on the order of about three to six mils in thickness.

In forming the relatively large size tapered rounded-cornered flaps which are provided on the above-described pouches, waste areas of a predetermined generally triangular shape are severed and removed from portions of the web of plastic packaging film. It is important that these waste areas be severed along clean smooth cut lines to avoid leaving rough edges or sharp corners on the flaps which might damage the products contained in the pouches upon insertion or removal thereof. Additionally, it is desirable that the flap forming operation be performed quickly and consistently with clean and accurately formed cut edges.

Accordingly, in accordance with one aspect of this invention the flaps are formed at a flap forming station comprising an improved type of reciprocating cutter adapted for successively severing and removing the waste areas on each stroke of the reciprocating cutter.

The reciprocating blade of the cutter is adapted for piercing the web at a predetermined point spaced from the free longitudinal edge of the web and for thereafter severing along two spaced apart cut lines extending from the point of piercing toward and through the free longitudinal edge of the web. Means are provided for grasping the web during the severing operation closely adjacent the free longitudinal edge thereof to facilitate severing the waste area free from the remaining web. Additionally, means are provided for ejecting the cut-out waste area clear of the advancing web after completion of the cutting stroke.

In accordance with another aspect of this invention, an improved method and means for heat sealing the webs together is provided which significantly increases the rate of production which can be achieved.

More particularly, when heat sealing relatively heavy gauge films, a signficant amount of contact time by the heat sealing member is ordinarily required in order to accomplish sealing, because of the thickness of the films and the amount of heat which must be driven therethrough. The present invention provides means upstream from the heat sealing member for preheating those areas of the web which are subsequently to be heat sealed to thereby permit the heat sealing member to accomplish sealing in a shorter amount of time and thereby increase the rate of production of the machine.

Some of the objects and advantages of the invention having been stated, others will appear as the description proceeds when taken in connection with the acompanying drawings, in which FIG. 1 is a block diagram illustrating a method of forming pouches in accordance with this invention;

Figure 1:
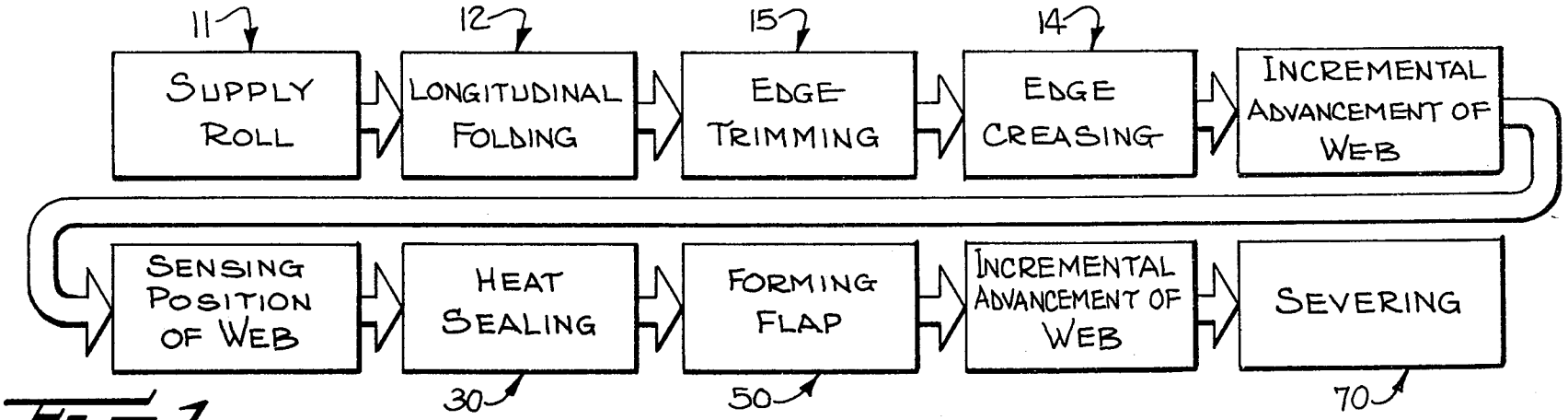
Figure 2:
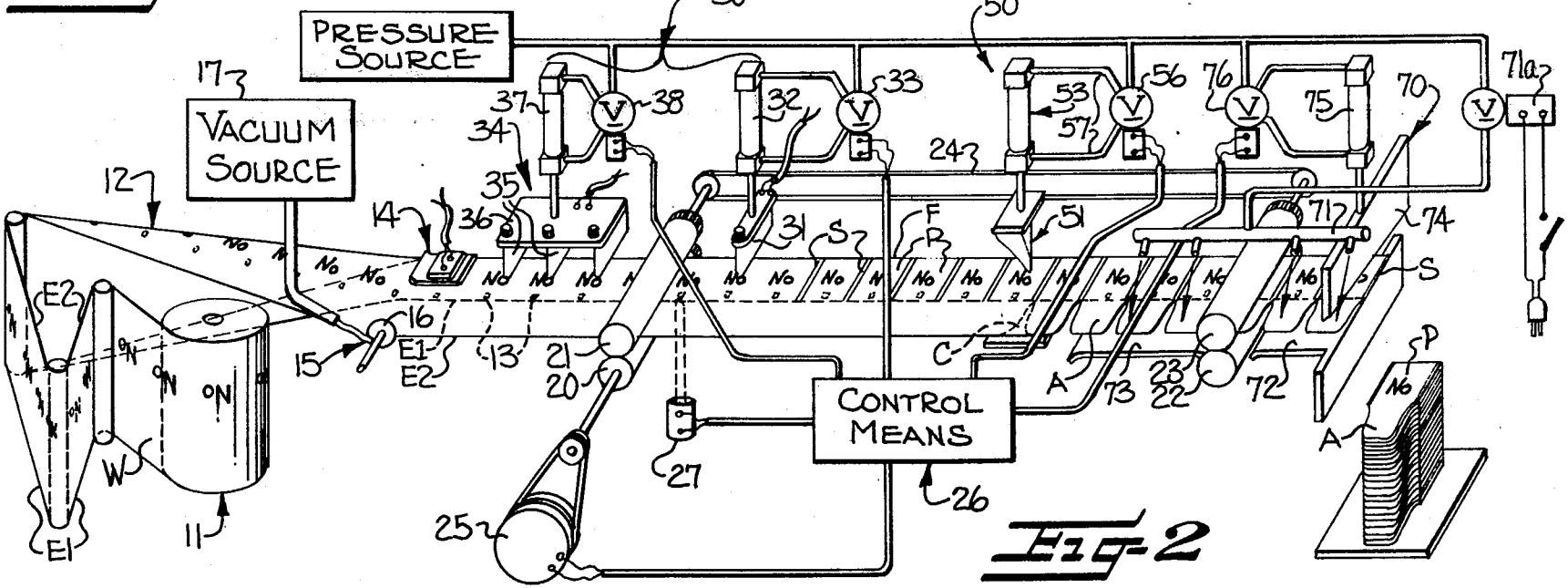
FIG. 2 is a schematic perspective view of a pouch forming machine in accordance with this invention.

Referring now more particularly to the drawings, in FIG. 2 is shown an apparatus for carrying out the method of this invention. As illustrated, a web W of plastic packaging film is advanced from a supply roll 11 thereof through a folding station, generally designated at 12, where the web is folded upon itself along a longitudinal fold line F located about one-third of the distance between opposite longitudinal edges so as to position one free longitudinal edge of the web, indicated at E1, between the fold line and the other free longitudinal edge of the web, indicated at E2. Thus, the web is folded to define a two-ply portion over about half of the width of the folded web and a single ply portion adjacent thereto over the remaining width of the folded web.

The pouches produced by the method and apparatus of this invention are particularly adapted for use as reusable containers for various kinds of products. Accordingly, the web W is preferably a relatively heavy gauge plastic packaging film having a thickness on the order of about three to about six mils. Web W may be either a unitary single ply sheet or a laminated composite structure. In either event, the inner surface of the web is readily heat sealable, and the web is folded upon itself as it passes through the folding station 12 with the heat sealable inner surface in confronting relation. The opposite or outer surface of the web W may be provided with a suitable design or indicia, illustrated in FIG. 2 by the word "No". As illustrated, the indicia is provided in a repeating pattern along the length of the web W, with the repeat length corresponding to the width of the pouches being formed. In addition to the printed indicia, a registration mark 13 is provided in each repeat along the length of the web for the purpose to be described hereinafter.

After folding, it may be desirable in many instances to crease the fold line F of the folded web to make the folded web lie flat during subsequent processing, and to facilitate stacking and handling of the pouches which are formed. Thus, as illustrated, upon leaving the folding station 12 the folded web passes through a creasing station 14 where heat is applied to the folded web sufficient to form a crease along the fold line.

Some variation in the order of performing the subsequent operations is permissible, but in the preferred form of the invention illustrated, the folded web next passes successively through an edge trimming station 15, a sealing station 30, a flap forming station 50 and a cut-off station 70.

At the edge trimming station 15, the free longitudinal edge E2 of the single ply portion of the web is trimmed to form a clean smooth edge which will serve as one end of the subsequently formed flap. A rotating cutter blade 16 of a conventional type cleanly trims the edge E2 of the web, while the trim waste is sucked away to a suitably located trash receptacle by a vacuum source 17.

The folded web is moved through the subsequent processing stations in successive incremental advancements by two longitudinally spaced apart cooperating pairs of feed rolls 20, 21 and 22, 23. The two pairs of feed rolls are suitably interconnected, as by the drive belt 24 illustrated, to operate in timed relation with one another. Preferably, the downstream pair of rolls 22, 23 rotates at a speed slightly greater (e.g. about 1 percent higher) than the upstream pair of rolls 20, 21 to maintain the folded web under tension between spaced pairs of feed rolls to facilitate sealing and cutting. A motor and clutch arrangement 25, under the control of a control means 26, drive the feed rolls 20, 21 and 22, 23 in precise incremental advancements to insure proper registration of the printed indicia with the heat seals and cut lines.

To facilitate obtaining accurate registration of the indicia after each incremental advancement, so that the web will be properly positioned in each processing station, the control means 26 may include an electric eye 27 positioned for sensing the arrival of the printed registration mark 13 at some predetermined point in the machine. The control means also includes control circuitry for effecting one cycle of each of the processing station, i.e. the sealing station 30, the flap forming station 50 and the cut-off station 70, as the web dwells in the various stations between successive incremental advancements.

The sealing station 30 includes an elongate electrically heated sealing member 31 positioned above the two-ply portion of the folded web. Sealing member 31 is mounted for reciprocating movement for being driven downwardly into contact with the two-ply portion of the web as the web dwells between successive incremental advancements to form a transversely extending seal area S in the two-ply portion of the folded web. Sealing member 31 may be driven by any suitable mechanical or fluid means, such as the two-way pneumatic cylinder 32 and control valve 33 illustrated.

In order to accomplish sealing of the two plies together in the seal area, it is necessary to heat the inner confronting surfaces of the web to the fusion temperature of the heat sealable plastic. This requires that a considerable amount of heat be driven through the web from the outer surface thereof, where the heated sealing member 31 contacts the web, to the inner surface thereof where fusion and bonding of the confronting inner surfaces of the web occurs. The amount of heat driven through to the confronting inner surfaces of the web is a function of the temperature of the heated sealing member 31 and the length of time the sealing member 31 remains in contact with the web.

Relatively thin packaging films can be heat sealed by contacting the film with a heated sealing member for a relatively short amount of time. However, relatively heavy gauge films, e.g. on the order of three to six mils in thickness as are preferably employed in the method and apparatus of this invention, requires a longer time of contact with the heated sealing member in order to accomplish sealing. This limits the rate of production which can be achieved when processing heavy gauge films.

In order to significantly reduce the amount of contact time required for the sealing member 31 to heat the inner surface of the web to the fusion temperature, the sealing station 30 of the present invention preferably includes, in addition to the sealing member 31, a preheating station 34. This preheating station includes one, or preferably several, elongate heated preheating members 35 similar to the heated sealing member 31. Each preheating member 35 is mounted upstream from the sealing member 31 a distance corresponding to an integral multiple of the advancement length or repeat length. As illustrated, three preheating members 35 are mounted on a common plate 36 for reciprocating movement into and out of engagment with the two-ply portion of the folded web. The preheating members 35 may be driven by any suitable mechanical or fluid means, such as the pneumatic cylinder 37 and control valve 38 illustrated.

Thus, as the folded web dwells in the sealing station 30 between each successive incremental advancement, predetermined areas of the two-ply portion of the web are preheated by contact with the preheating members 35. As illustrated, the three preheating members 35 are spaced one repeat length apart from each other. Thus, the predetermined areas being preheated will be successively contacted by each of the three preheating members as the web advances through the preheating station 34.

As these preheated areas of the web advance further downstream, they are contacted by the heated sealing member 31 and sealing is accomplished. The temperatures of the preheating members 35, and the temperature of the sealing member 31, are controlled by respective selfcontained individually adjustable thermostats. The preheating members 35 are preferably set to a temperature sufficient to heat the inner surfaces of the two plies to an elevated temperature just below the sealing or fusion temperature, while the sealing member 31 is set at a slightly higher temperature sufficient to supply the additional heat needed to accomplish sealing. By preheating the areas of the two-ply portion which are later to be heat sealed, a higher rate of production can be achieved from the machine since a shorter amount of contact time is required for the heated sealing member 31 to accomplish the sealing. In addition, this permits maintaining the sealing member 31 at a lower temperature, and thus avoids burning or discoloring the seal areas by using an excessive temperature in an attempt to accomplish sealing more quickly.

As a result of the successive sealing operations performed at the sealing station 30, it will be seen that the two-ply portion of the folded web emerges from the sealing station with a plurality of longitudinally spaced apart transversely extending seal areas S thereacross defining a series of successive pouches P interconnected by the seal areas. As the advancing web dwells in the flap forming station 50 between successive incremental advancements, a reciprocating cutter blade 51 located above the single ply portion of the folded web descends and pierces the web at a predetermined point transversely aligned with one of the seal areas and severs and removes from the single ply portion a transversely extending waste area or "chip" C of elongate, generally triagular shape. This forms the single ply portion into a series of successive flaps A extending alongside each of the successive pouches P, the flaps being adapted for being folded over the pouches to close the same. The structure and operation of the flap forming station will be described in more detail hereinafter.

The web now advances from the flap forming station through the downstream pair of feed rolls 22, 23 and to the cut-off station 70. In order to keep the flaps extending flat during advancement of the pouches through the feed rolls 22, 23 and through the cut-off station 70, streams of air are directed downwardly upon the flaps from a suitable conduit 71 positioned above the advancing web. Conduit 71 is connected to a suitable source of compressed air, and the flow of air may be controlled as desired by suitable valve means 71a. The streams of air hold the flaps down against underlying support surfaces 72 and 73. This prevents the flaps from moving out of the plane of the web and being folded or crimped during passage through the feed rolls 22, 23.

As the web dwells in the cut-off station 70 between successive incremental advancements, a reciprocating cutter blade 74, mounted above the advancing web, descends to sever the successive pouches P apart along the interconnecting seal area S. Reciprocating blade 74 is driven by any suitable mechanical or fluid means, such as the pneumatic cylinder 75 and valve 76 illustrated.

As noted earlier, each of the preheating members 35 in the preheating zone 34 is spaced upstream from the heated sealing member 31 a distance corresponding to an integral multiple of the repeat length of the printed indicia. This repeat length corresponds to the width of the pouches being formed. Similarly, cutter blade 51 in flap forming station 50 and cutter blade 74 in the cut-off station 70 are each located downstream from the sealing member 31 an integral number of repeat lengths. Each time the web dwells between successive advancements, the sealing station 30, the flap forming station 50 and the cut-off station 70 each perform one cycle of their respective operations. As noted earlier, the coordination and timing of the operation of these stations with the advancement of the web is accomplished by control means 26.

Referring now more particularly to the construction and operation of the flap forming station 50, the cutter blade 51 thereof is designed for cutting an elongate generally U-shaped or V-shaped triangular waste area or "chip" C from the single ply portion of the web. The triangular waste area has a rounded point or apex and sides which flare outwardly somewhat adjacent to the base. Thus, the flaps formed by the removal of the waste area are tapered along their length and have rounded corners.

As illustrated, cutter blade 51 is formed from a generally U-shaped plate having spaced opposing walls defining an open or hollow interior. The blade may be formed of any suitable material which will hold a sharp edge, such as carbon steel for example. The U-shaped cutter blade 51 has a sharpened cutting edge angularly related to the web in such a manner that upon descending of the cutter blade, the rounded or U-shaped point 51*a* thereof first pierces the web, and then the web is severed along two spaced apart transversely extending diverging cut lines toward and through the free longitudinal edge E2 of the web by two cutting edges 51b divergingly extending from the point 51*a*.

Figure 4:
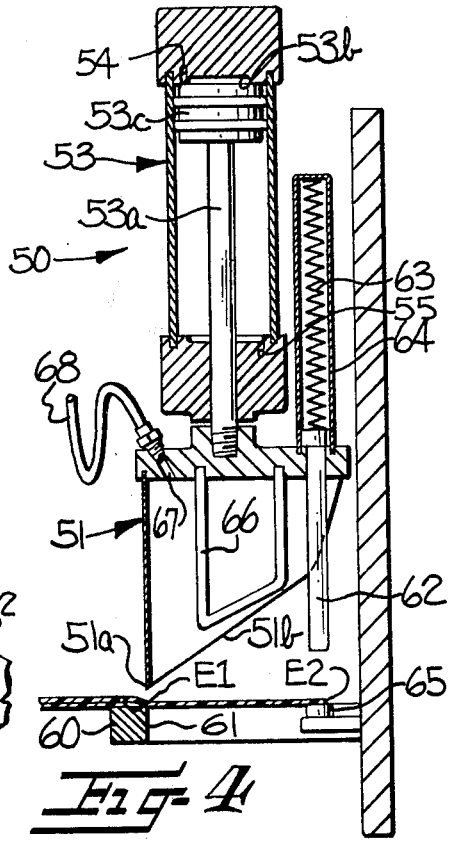
FIG. 4 is a sectional view through the cutting device of FIG. 3, showing the cutter in its uppermost position prior to initiation of a cutting stroke.

Cutter blade 51 is mounted on a support plate 52 which, in turn, is driven by the reciprocating shaft 53*a* of a two-way pneumatic cylinder assembly 53. Referring to FIG. 4, it will be noted that a concavity or depression 53*b* is provided at each end of the cylinder. This concavity defines a small air chamber between the end wall of cylinder 53 and the end piston 53*c* when the piston is at the end of its stroke in each direction. This small air chamber forms a pneumatic cushion for the piston 53*c* when it reaches the end of its stroke in each direction. The cushioning provided by the concavity 53b avoids shearing of the shaft 53*a* which carries cutter blade 51 due to metal fatigue otherwise resulting after a period of time from the repeated abrupt stopping of the shaft 53*a* as piston 53*c* strikes the end of cylinder 53.

The operation of pneumatic cylinder assembly 53 is controlled by a solenoid-operated valve 56, which, in turn, is connected to control means 26 by suitable wiring. Ports 54 and 55 at the upper and lower ends of the cylinder 53 are connected to control valve 56 by tubing 57.

Figure 3:
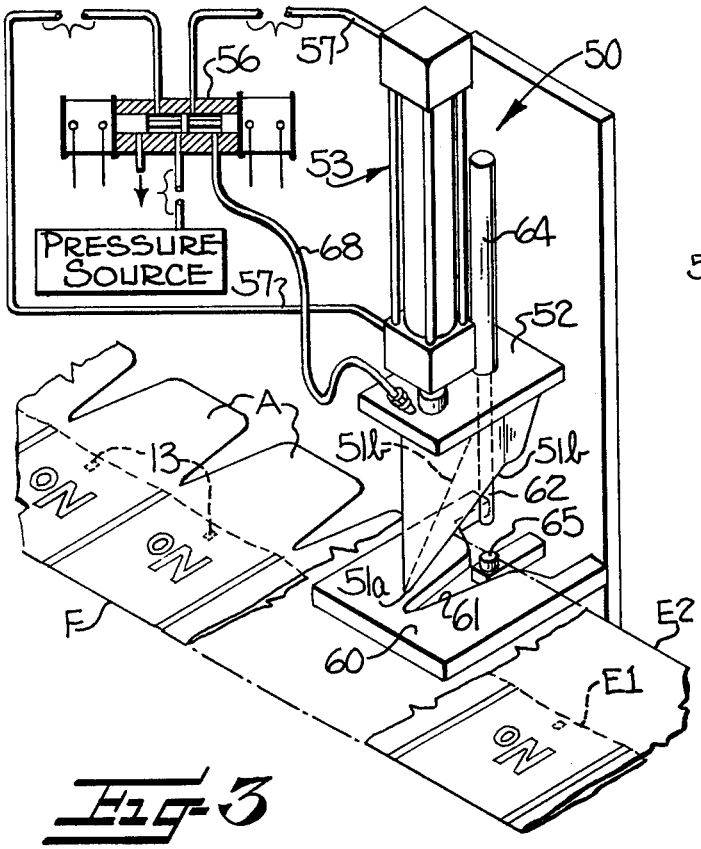
FIG. 3 is a perspective view of the reciprocating cutting device employed for cutting the advancing web to form flaps on the pouches.

Referring to FIG. 3, a support plate 60 is provided beneath the cutter blade 51 for supporting the advancing web thereon. Support plate 60 has a cut-out 61 corresponding in shape to the generally U-shaped triangular outline of cutter blade 51 so that the blade 51 may pass downwardly therethrough. Thus, support plate supports the web in areas surrounding the waste area to be removed, but the waste area itself is unsupported.

FIG. 4 illustrates the cutter blade in its uppermost position prior to the initiation of a cutting stroke. A spring loaded gripper shaft 62 extends downwardly from support plate 52 between the diverging and opposing legs or walls defining the hollow portion of the cutter blade. Gripper shaft 62 is biased in a downward direction by a coil spring 63 located inside a cylindrical housing 64 carried by support plate 52. A cooperating gripping surface 65, preferably a resilient material such as rubber, is located directly beneath gripper shaft 62. Gripper shaft 62 extends downwardly about two-thirds of the overall length of the cutter blade. Thus, during the downward stroke of the cutter blade, it will be seen that the web is first pierced by the lowermost pointed end 51a of the cuter blade. As the blade continues its downward stroke the web is severed along two diverging cut lines toward the free longitudinal edge of the web. When the cutter blade descends about a third of the distance through its cutting stroke, gripper shaft 62 engages support 65 and grips the waste area being cut-out throughout the remaining downward stroke of the cutter blade. This gripping or holding action provides a stabilizing force for the cutter blade to bear against during the latter stages of the cutting operation when the waste area or chip is almost entirely severed from the remaining web, and is particularly helpful in forming the outwardly flaring endmost portion of the waste area.

Figure 5:
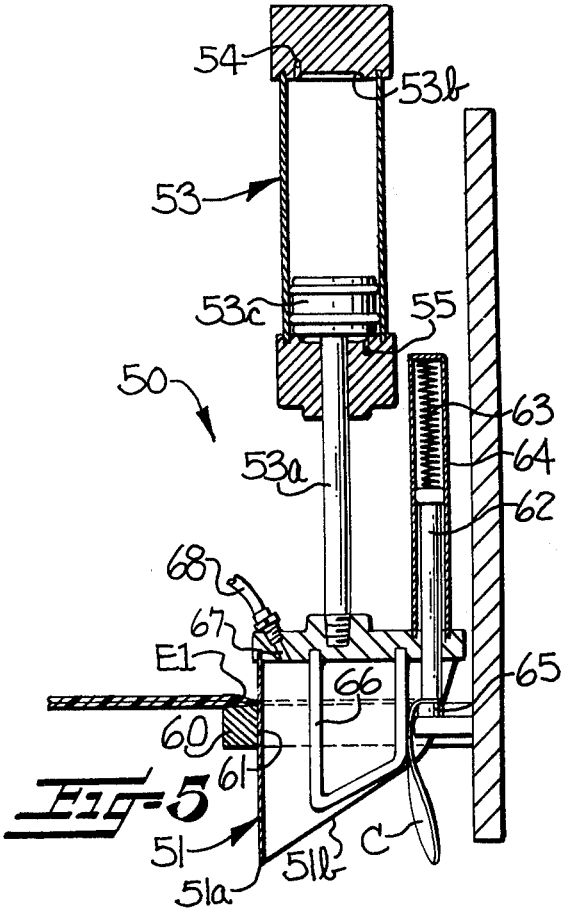
FIG. 5 is a sectional view similar to FIG. 4, but showing the cutter in its lowermost position after completion of a cutting stroke.
Figure 6:
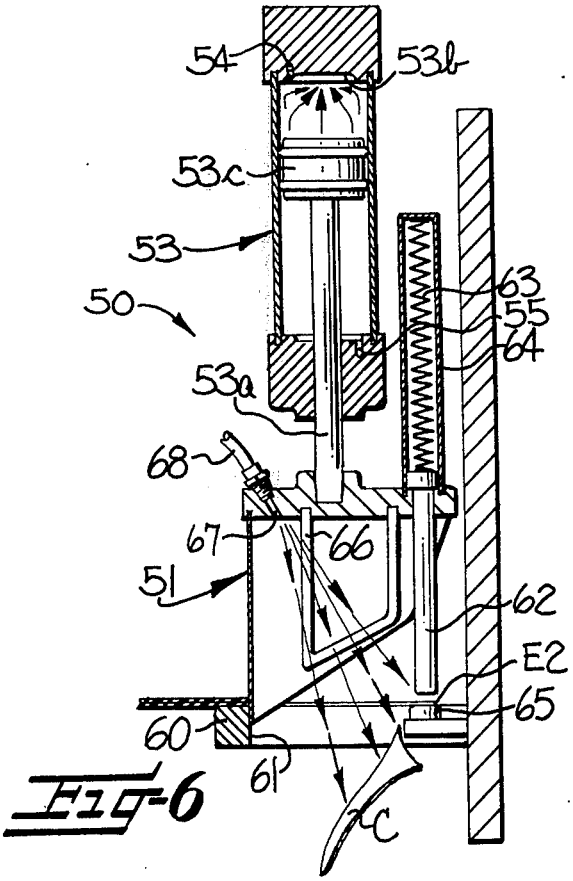
FIG. 6 is a sectional view similar to FIG. 4, but showing the cutter on its return stroke after completion of a cutting stroke.

A generally U-shaped pusher bar or rod 66 mounted between opposing sides of the cutter blade is provided for pushing the cut-out waste area or chip away C from the remaining portion of the web so as to be in a downwardly trailing position as illustrated in FIG. 5 at the completion of the cutting stroke. This prevents the chips from accumulating within the blade and prepares the chip for the ejection step which follows.

Finally, on the return upward stroke of the cutter blade, the gripper rod 62 releases its grip on the cut-out waste area or chip C. At the same time, a blast of air is directed at the chip from within the hollow portion of the cutter blade through port 67 located in support plate 52. This blast of air serves to eject the chip clear of the advancing web where it may be collected in a suitable trash receptacle.

It will be noted that the blast of air is obtained from the exhaust from the upward stroke of the piston 53c. As illustrated, the port 67 is connected by flexible tubing 68 to one exhaust port on solenoid operated valve 56. The exhaust air from the downward stroke of the piston 53c is discharged to the atmosphere without being directed to the interior of the hollow cutting blade.

In the drawings and specification there has been set forth a preferred embodiment of the invention, and although specific terms are employed, they are used in a generic and descriptive sense only and not for purposes of limitation.

We claim:

1. A method for cutting a web of plastic film to form successive flaps therein comprising advancing the web in successive incremental advancements of predetermined length past a reciprocating cutter blade while moving the cutter blade toward and into engagment with the web each time the web dwells between successive incremental advancements, and severing and removing from the web with the cutter blade, generally triangular shaped waste areas extending transversely across the web from one free longitudinal edge thereof, each successive severing and removing operation comprising the steps of supporting portions of the web surrounding the waste area to be removed while piercing the web with the cutter blade at a predetermined point spaced from the free longitudinal edge of the web and corresponding to one end of the waste area, thereafter severing the web with the cutter blade from the point of piercing along two diverging cut lines extending generally transversely across the web toward the free longitudinal edge while grasping the web in said waste area and closely adjacent to said free longitudinal edge, continuing grasping the web while continuing severing with the cutter blade along the two cut lines and on opposite sides of the point of grasping and to and through the free longitudinal edge of the web to therby cut the waste area free from the remaining web, and releasing the cut-out waste area and ejecting the same clear of the advancing web.

2. A method according to claim 1 wherein the step of ejecting the cut-out waste area clear of the advancing web comprises directing a burst of air at the cut-out waste area during the return stroke of the reciprocating cutter away from the web.

3. A method of forming successive pouches from a web of plastic film comprising advancing the web of plastic film from a supply source to a folding station and folding the web along a longitudinal fold line so as to position one free longitudinal edge of the web between the fold line and the other free longitudinal edge of the web to thereby define a two-ply portion between the fold line and said one free longitudinal edge of the web and a single ply portion adjacent thereto between the said one free longitudinal edge of the web and said other free longitudinal edge, advancing the folded web from the folding station to a sealing station and sealing together confronting surfaces of the two-ply portion along longitudinally spaced apart seal areas extending transversely across the two-ply portion to thereby define in the two-ply portion of the folded web a series of successive pouches interconnected by the seal areas, advancing the thus sealed folded web from the sealing station to a flap forming station and successively severing and removing from the single ply portion of the web, in areas adjacent to and in transverse alignment with each of the seal areas, longitudinally spaced transversely extending waste areas to thereby form the single ply portion into a series of successive flaps extending alongside each of the succesive pouches and adapted for being folded over the pouches to close the same, each successive severing and removing operation comprising the steps of supporting the single ply portion of the web surrounding the waste area to be removed while piercing the web at a predetermined point spaced from the free longitudinal edge of the single ply portion and corresponding to one end of the waste area, thereafter severing the single ply portion from the point of piercing along two spaced apart cut lines extending generally transversely across the single ply portion toward the free longitudinal edge while grasping the single ply portion of the web in said waste area and closely adjacent to said free longitudinal edge, maintaining grasping the web while continuing severing along the two transversely extending cut lines and on opposite sides of the point of grasping and to and through the free longitudinal edge of the web to thereby cut the waste area free from the remaining web, and releasing the cut-out waste area and ejecting the same clear of the advancing web, and advancing the thus formed series of interconnected pouches from the flap forming station to a cut-off station and successively cutting transversely across the folded web and across a medial portion of each seal area to thereby separate the interconnected pouches from one another.

4. A method according to claim 3 wherein the folding of the web comprises folding the web so as to position said one free longitudinal edge of the web about midway between the other free longitudinal edge and the fold line to form the single ply portion and the two-ply portion of substantially the same width.

5. A method according to claim 4 wherein the point of piercing the single ply portion of the web is closely adjacent to the two-ply portion, and the severing of the web occurs along two spaced apart cut lines extending along divering paths from the point of piercing and across the single ply portion so that the waste areas thus severed and removed from the single ply portion of the web are generally triangular in shape and extend across substantially the entire width of the single ply portion, and the flaps thus formed are tapered along their length.

6. A method according to claim 3 wherein the waste areas are severed and removed from the single ply portion of the web by a reciprocating hollow cutter blade, said cutter blade having one end thereof sharpened and positioned for piercing the web at said predetermined point, and said cutter blade having a pair of spaced apart sharpened cutting edges extending from said one sharpened end for severing the web from the point of piercing and along said two spaced apart transversely extending cut lines, and wherein the piercing and severing of the waste area occurs in rapid succession upon each stroke of the reciprocating cutter blade toward the web.

7. A method according to claim 6 wherein the ejecting of the cut-out waste area following severing comprises directing a burst of air within the hollow cutter blade and on the cut-out waste area during the return stroke of the cutter blade away from the web.

8. A method according to claim 3 wherein the web of plastic film is heat sealable, and the step of sealing together confronting surface of the two-ply portion of the web along longitudinally spaced apart seal areas comprises contacting the outer surface of the two-ply portion with a heated sealing member in said seal areas for a time sufficient to effect fusion bonding of confronting inner surfaces of the two plies in the seal areas.

9. A method according to claim 8 wherein the sealing together of confronting surfaces of the two-ply portion of the web includes the additional step of preheating the web in predetermined longitudinally spaced areas corresponding to the seal areas prior to advancement of the web to the heated sealing member to thereby reduce the time required for heated sealing member to effect fusion bonding and to accordingly increase the rate of production of the pouches.

10. A method according to claim 9 wherein the preheating of the web in predetermined longitudinally spaced areas corresponding to the seal areas comprises contacting the web in said predetermined areas with at least one heated member at a temperature and for a time insufficient to effect fusion bonding but sufficient to preheat the seal areas to an elevated temperature so as to substantially reduce the time required for the heated sealing member to subsequently effect fusion bonding.

11. Apparatus for cutting a web of plastic film to form successive flaps therein comprising means for advancing the web along a predetermined path in successive incremental advancements of predetermined length, a reciprocating cutter blade positioned adjacent to the advancing web and adapted for severing and removing from the web, generally triangular shaped waste areas extending transversely across the web from one free longitudinal edge thereof, means positioned opposite said cutter blade for supporting portions of the web surrounding the waste area to be removed and having an opening therein of a shape corresponding to the generally triangular shaped waste area for receiving the reciprocating cutter blade therethrough during the cutting stroke.

means operating in timed relation with said advancing means for moving the cutter blade toward and into engagment with the web each time the web dwells between successive incremental advancements, said cutter blade having a sharpened point positioned for piercing the web at a predetermined point spaced from the free longitudinal edge thereof and corresponding to one end of the generally triangular shaped waste area to be removed, and a pair of spaced apart cutting edges extending from the sharpened point along a diverging path and being inclined at an angle to the plane of the web for thereafter severing the web from the point of piercing along two diverging cut lines extending across the web to the free longitudinal edge thereof, means operating in timed relation with the cutter blade for grasping the web in said waste area closely adjacent to the free longitudinal edge thereof during severing of the waste area along said cut lines, and for releasing the cut-out waste area upon completion of the severing thereof from the remaining web, and means for ejecting the cut-out waste area clear of the advancing web upon completion of severing thereof from the remaining web.

12. Apparatus according to claim 11 wherein said means for ejecting the cut-out waste area clear of the advancing web comprises means positioned between the divergingly arranged cutting edges of the cutter blade for directing a burst of air at the cut-out waste area during the return stroke of the reciprocating cutter blade away from the web.

13. Apparatus according to claim 12 wherein said means for moving the cutter blade toward and away from the web comprises pneumatic cylinder means, and wherein said means for directing a burst of air at the cut-out waste area is communicatively interconnected with said pneumatic cylinder for directing toward said cut-out waste area the exhaust air from the return stroke of the pneumatic cylinder.

14. Apparatus according to claim 13 wherein means are provided at each end of the pneumatic cylinder for cushioning the movement of the piston thereof at each end of its stroke of travel.

15. Apparatus for forming successive pouches from a web of plastic film comprising a folding station including means for receiving a web of plastic film from a supply source and folding the web along a longitudinal fold line so as to position one free longitudinal edge of the web between the fold line and the other free longitudinal edge of the web to thereby form a two-ply portion between the fold line and said one free longitudinal edge of the web and a single ply portion adjacent thereto between said one free longitudinal edge of the web and the other free longitudinal edge, means for advancing the web through the folding station and forwardly therefrom along a predetermined path, a sealing station positioned forwardly of the folding station and including means for sealing confronting surfaces of the two-ply portion of the web together along longitudinally spaced apart seal areas extending transversely across the two-ply portion to thereby define a series of successive pouches interconnected by the seal areas as the folded web is advanced through the sealing station, a flap forming station positioned forwardly of the folding station and including means for successively severing and removing from the single ply portion, as the folded web is advanced through the flap forming station, longitudinally spaced transversely extending waste areas of predetermined shape to thereby form the single ply portion into a series of successive flaps adapted for being folded over the pouches formed in the two-ply portion, said severing and removing means including means for supporting the single ply portion of the web surrounding the predetermined shaped waste area to be removed, a reciprocating cutter blade having one end thereof sharpened and positioned for piercing the single ply portion of the web at a predetermined point spaced from the free longitudinal edge of the single ply portion and corresponding to one end of the waste area to be removed and having a pair of spaced apart sharpened cutting edges extending from said one sharpened end and being inclined at an angle to the plane of the web for thereafter severing the single ply portion from the point of piercing along two spaced apart cut lines extending generally transversely across the single ply portion to the free longitudinal edge thereof, means operating in timed relation with said cutter blade for grasping the single ply portion of the web in said waste area closely adjacent the free longitudinal edge during severing of the waste area along said cut lines, and for releasing the cut-out waste area upon completion of severing thereof from the remaining web, and means operating in timed relation with said cutter blade for ejecting the cut-out waste area clear of the advancing web after the piercing and severing operation is completed, and a cut-off station located forwardly of the sealing station and the flap forming station and including means for successively cutting transversely across the folded web and across a medial portion of each seal area to thereby separate the interconnected pouches from one another.

16. Apparatus according to claim 15 wherein said one end of the cutter blade is positioned for piercing the single ply portion of the web at a point closely adjacent to the two-ply portion, and said pair of spaced apart sharpened cutting edges extend along diverging paths from said one sharpened end of the cutter blade so that the waste areas thus severed and removed from the single ply portion of the web are generally triangular in shape and extend across substantially the entire width of the single ply portion, and the flaps thus formed are tapered along their length.

17. Apparatus according to claim 15 wherein said means for ejecting the cut-out waste area clear of the advancing web comprises means for directing a burst of air on the cut-out waste area during the return stroke of the cutter blade away from the web.

18. Apparatus according to claim 15 wherein the web of plastic film is heat sealable, and said sealing station comprises an elongate heated sealing member mounted for movement into and out of engagement with the advancing web in said seal areas for heating the web to fusion temperature to form heat seals, and at least one elongate preheating member positioned upstream from said sealing member and mounted for movement into and out of engagement with the advancing web in said seal areas for preheating the seal areas prior to advancement to the sealing member to thereby reduce the time required for the heating sealing member to heat the web to fusion temperature, and to thereby increase the rate of production of the pouches.

19. Apparatus for forming successive pouches from a web of heat sealable plastic film comprising a folding station including means for receiving a web of plastic film from a supply source and folding the web along a longitudinal fold line so as to position one free longitudinal edge of the web approximately midway between the fold line and the other free longitudinal edge of the web to thereby form a two-ply portion and a single ply portion of substantially equal width adjacent thereto, means for advancing the web through the folding station and forwardly therefrom along a predetermined path in successive incremental advancements of accurately predetermined length, a sealing station positioned forwardly of the folding station and including an elongate heated sealing member mounted for reciprocating movement into and out of engagement with said web for forming an elongate heat seal area extending transversely across the two-ply portion of the web, and means operating in timed relation with said advancing means for moving said sealing member into engagement with the web each time the web dwell in the sealing station between successive incremental advancements, said sealing station thereby forming a series of longitudinally spaced apart seal areas extending transversely across the two-ply portion of the web to thereby define a series of succesive pouches interconnected by the seal areas, a flap forming station positioned forwardly of the folding station for forming the single ply portion of the web into a series of successive tapered flaps adapted for being folded over the two-ply portion, said flap forming station including a reciprocating cutter blade, means operating in timed relation with said advancing means for moving said cutter blade toward and into engagement with said web each time the web dwells in the flap forming station between successive advancements for thereby severing and removing from the single ply portion a generally triangular shaped waste area extending transversely across substantially the entire width of the single ply portion, and means positioned opposite said cutter blade for supporting portions of the web surrounding the waste area to be removed and having an opening therein of a shape corresponding to the generally triangular shaped waste area for receiving the reciprocating cutter blade therethrough during the cutting stroke, said cutter blade having a sharpened point for piercing the single ply portion of the web at a predetermined point spaced from the free longitudinal edge of the single ply portion and corresponding to one end of the triangular shaped waste area to be removed, and a pair of spaced apart cutting edges extending from the sharpened point along a diverging path and being inclined at an angle to the plane of the web for thereafter severing the single ply portion from the point of piercing along two diverging cut lines extending across the single ply portion to the free longitudinal edge thereof, said flap forming station also including means operating in timed relation with the cutter blade for grasping the single ply portion of the web in said waste area closely adjacent the free longitudinal edge during severing of the waste area along said cut lines, and for releasing the cut-out waste area upon completion of severing thereof from the remaining web, and means for ejecting the cut-out waste area clear of the advancing web upon completion of severing thereof from the remaining web, and a cut-off station located forwardly of the sealing station and the flap forming station and including a reciprocating cutter blade operating in timed relation with said advancing means for successively cutting transversely across the folded web and across a medial portion of each seal area each time the web dwells in the cut-off station between successive advancements to thereby separate the interconnected pouches from one another.

* * * * *

UNITED STATES PATENT AND TRADEMARK OFFICE

CERTIFICATE OF CORRECTION

PATENT NO. : 4,002,519

DATED : January 11, 1977

INVENTOR(S) : Ronald E. Moseley and Henry G. Stewart

It is certified that error appears in the above-identified patent and that said Letters Patent are hereby corrected as shown below:

Column 1, Line 55, "signficant" should be --significant--;

Column 3, Line 18, "drive" should be --drives--;

Column 6, Line 3, after "end", second occurrence, insert --of--;

Column 7, Line 45, "therby" should be --thereby--;

Column 8, Line 51, "divering" should be --diverging--;

Column 9, Line 10, "surface" should be --surfaces--;

Column 11, Line 53, "heating" should be --heated--;

Column 12, Line 11, "dwell" should be --dwells--.

Signed and Sealed this

Twelfth Day of April 1977

[SEAL]

*Attest:*

RUTH C. MASON
*Attesting Officer*

C. MARSHALL DANN
*Commissioner of Patents and Trademarks*